United States Patent [19]

Brolund

[11] Patent Number: 4,485,549

[45] Date of Patent: Dec. 4, 1984

[54] APPARATUS FOR CHANGING THE TOOLS OF A PUNCH PRESS

[75] Inventor: Theodore F. Brolund, Rockford, Ill.

[73] Assignee: W. A. Whitney Corp., Rockford, Ill.

[21] Appl. No.: 492,796

[22] Filed: May 9, 1983

[51] Int. Cl.[3] ..... B23Q 3/157

[52] U.S. Cl. ..... 29/568; 72/446; 83/563; 83/698

[58] Field of Search ..... 29/568; 72/446; 83/563, 83/701, 698

[56] References Cited

U.S. PATENT DOCUMENTS

| | | | |
|---|---|---|---|
| 3,548,480 | 12/1970 | Daniels | 29/568 X |
| 3,678,562 | 7/1972 | Leibinger | 29/400 |
| 3,779,122 | 12/1973 | Sanvell | 83/698 |
| 3,816,904 | 6/1974 | Herb | 29/568 |
| 4,103,414 | 8/1978 | Herb et al. | 29/568 |

FOREIGN PATENT DOCUMENTS

| | | | |
|---|---|---|---|
| 478587 | 6/1929 | Fed. Rep. of Germany | 83/701 |
| 104089 | 8/1979 | Japan | 29/568 |
| 372013 | 6/1973 | U.S.S.R. | 83/698 |

*Primary Examiner*—William R. Briggs

*Attorney, Agent, or Firm*—Leydig, Voit, Osann, Mayer & Holt, Ltd.

[57] ABSTRACT

The punch, stripper and die of a punch press are formed with laterally projecting tongues adapted to telescope releasably into three vertically spaced sockets formed in a hand-held cartridge for supporting the tools and for facilitating insertion of the tools into and removal of the tools from the punch press.

9 Claims, 5 Drawing Figures

APPARATUS FOR CHANGING THE TOOLS OF A PUNCH PRESS

BACKGROUND OF THE INVENTION

This invention relates to apparatus for inserting a punch and die into and for removing a punch and die from a punch press adapted to reciprocate the punch downwardly and upwardly. More particularly, the invention relates to apparatus in the form of a hand-held cartridge adapted to hold the punch and die in superimposed relationship. With the tools so held, the cartridge may be moved manually to insert the tools into the tool holders of the punch press. After the tools have been locked into the holders, the cartridge is withdrawn from the press and, as an incident thereto, releases the tools and leaves the tools in the holders.

The tools are removed from the press by manually shifting the empty cartridge into the press to cause the cartridge to couple up with the tools. After the tools have been unlocked from the tool holders, the cartridge is withdrawn from the press to remove the tools from the holders.

A cartridge of the foregoing type is disclosed in Leibinger U.S. Pat. No. 3,678,562. In that cartridge, each tool is held by a fork-shaped holder formed by a pair of arms which embrace the tool. While the Leibinger-type cartridge has been used commercially, it does present some problems. For example, it is possible for one of the tools to be incorrectly loaded into the fork-shaped holder with an improper angular orientation. When that tool is subsequently loaded into the press and operated, the tool may damage itself, the coacting tool or both. The tools sometimes tend to become cocked in the fork-shaped holders and fail to aline properly with the tool holders of the press. Also, the fork-shaped holders tend to locate the tools a considerable distance from the hand grip of the cartridge. The cantilever effect of the heavy tools acting on a relatively long moment arm makes the cartridge difficult to lift and manipulate.

SUMMARY OF THE INVENTION

The general aim of the present invention is to provide new and improved tool changing apparatus, preferably of the cartridge-type, which effects positive holding of the tools, which insures against cocking and improper orientation of the tools and which, at the same time, is well-balanced so as to facilitate lifting and maneuvering of the tools.

A more detailed object is to achieve the foregoing by providing a tool changing cartridge having sockets which telescopically and non-rotatably receive laterally projecting tongues on the tools. By virtue of the sockets and the tongues, it is impossible to orient the tools improperly in the cartridge. In addition, the telescopic effect of the tongues and sockets prevents the tools from cocking relative to the cartridge while allowing the tools to be located closely adjacent the hand grip of the cartridge so as to better balance the weight of the overall assembly.

The invention also resides in the novel mechanism for positively holding the tongues of the tools in the sockets and for facilitating easy release of the tongues.

These and other objects and advantages of the invention will become more apparent from the following detailed description when taken in conjunction with the accompanying drawings.

DETAILED DESCRIPTION OF THE PREFERRED EMBODIMENT

Figure 1:
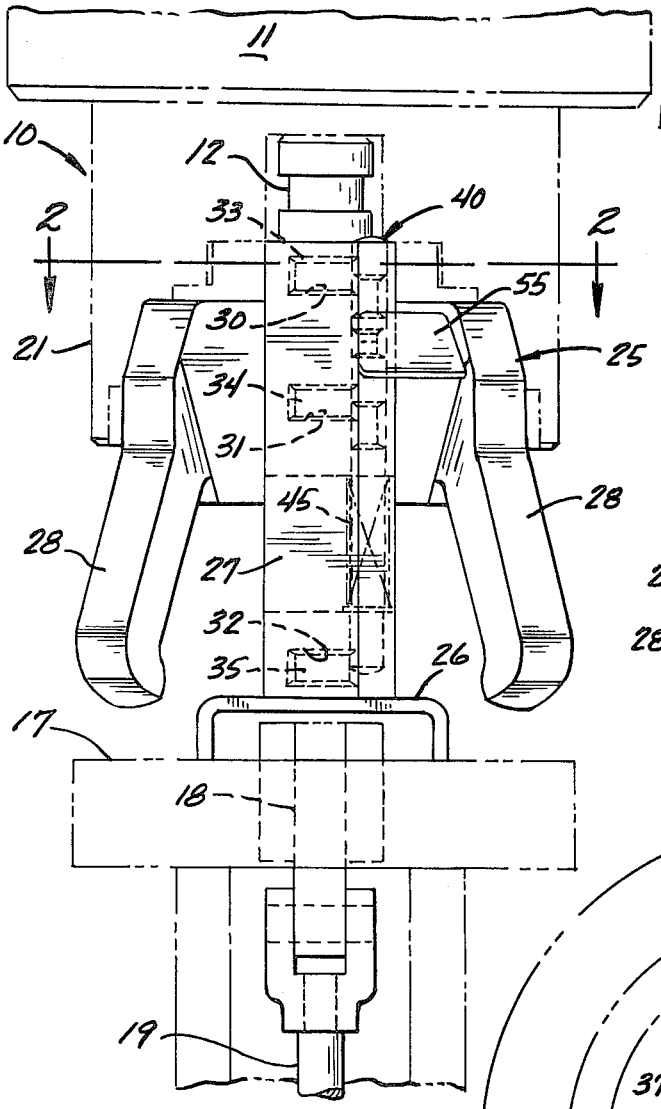
FIG. 1 is a rear elevational view of a new and improved tool changing cartridge incorporating the unique features of the present invention, the cartridge being shown in conjunction with a typical punch press.

As shown in the drawings for purposes of illustration, the invention is embodied in apparatus for changing the tools of a punch press 10 having a vertically reciprocable ram 11. Movable upwardly and downwardly with the ram is a punch 12 (FIG. 3) for forming a hole in a workpiece (not shown). The punch is supported within a punch holder 13 on the lower end of the ram and is adapted to be loaded sidewise into the punch holder through an opening in one side of the holder. After the punch has been inserted into the holder, a vertically movable wedge 14 (FIG. 4) is shifted downwardly into engagement with one side of the punch to lock the latter securely in the holder.

Figure 3:
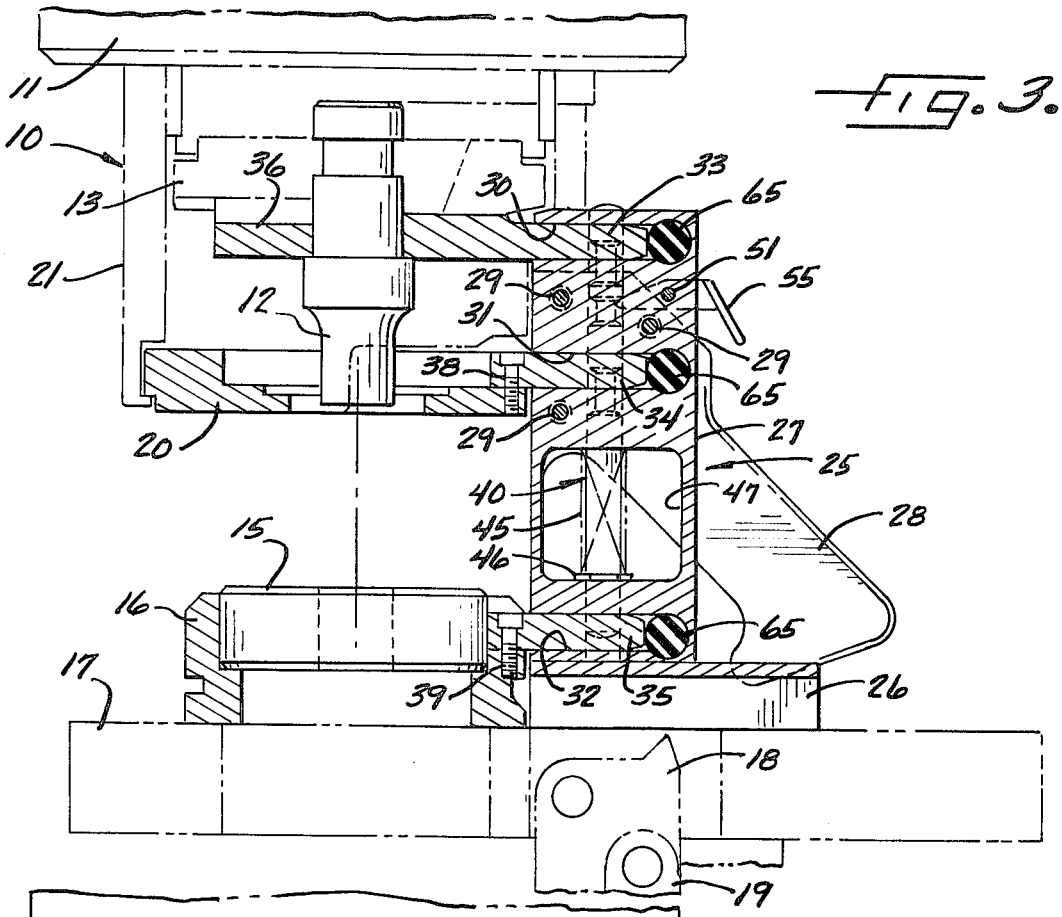
FIG. 3 is a cross-section taken substantially along the line 3—3 of FIG. 2 and shows the tools coupled to the cartridge.
Figure 4:
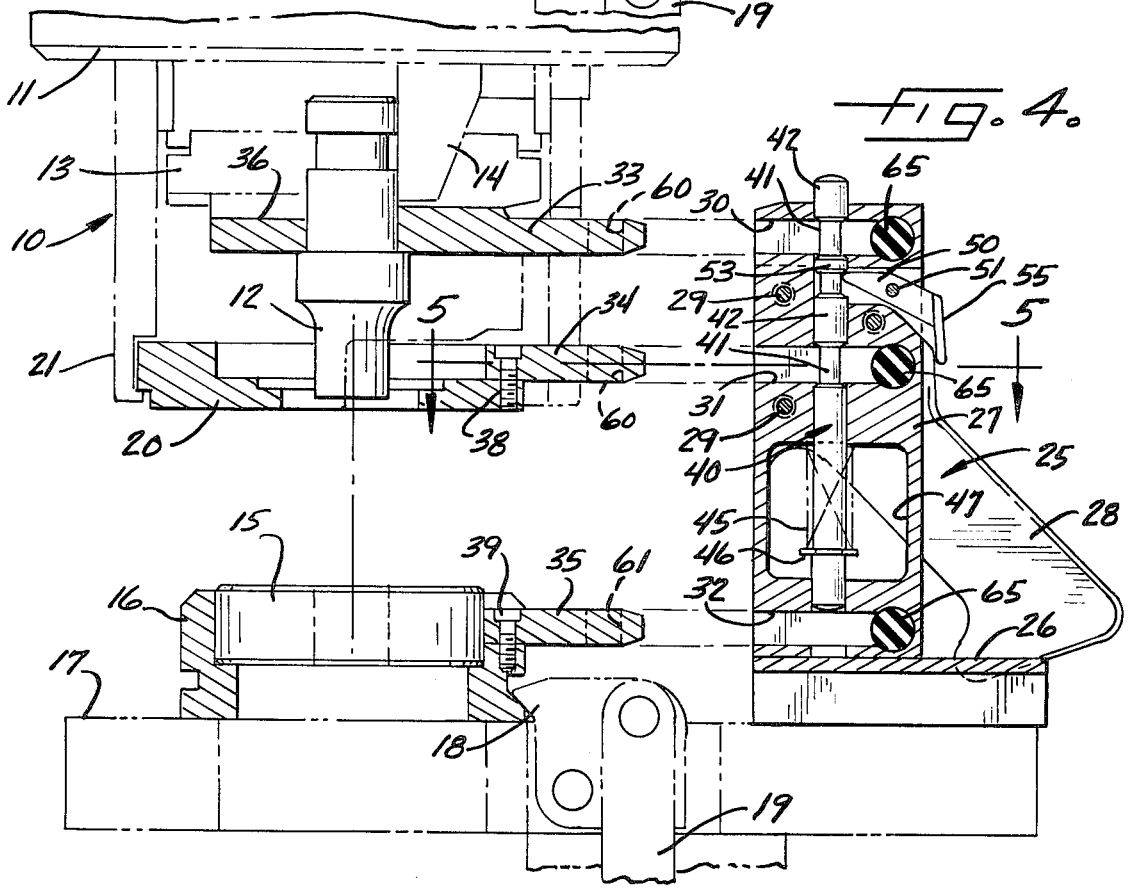
FIG. 4 is a cross-section taken substantially along the line 4—4 of FIG. 2 and shows the tools uncoupled from the cartridge.

The punch 12 coacts with an underlying die 15 (FIG. 3) supported within a ring-like die adaptor 16 which rests on the die holding bolster 17 of the press 10. After the die adaptor has been properly placed on the bolster, a pivoted clamp 18 is swung from the position shown in FIG. 3 to the position shown in FIG. 4 to lock the die adaptor to the bolster. Pivoting of the clamp is effected by a vertically reciprocable rod 19 (FIGS. 1 and 4).

Located between the punch 12 and the die 15 is a stripper 20 (FIG. 3) which holds the workpiece downwardly against the die when the punch is retracted upwardly out of the workpiece. The stripper is supported within a stripper housing or holder 21 on the lower end of the ram 11 and is adapted to be loaded radially or sidewise into the stripper holder. After the stripper has been inserted into the stripper holder, a latching mechanism (not shown) is actuated in order to lock the stripper in the holder.

The tools 12, 15 and 20 are adapted to be simultaneously inserted into and simultaneously removed from their respective holders 13, 17 and 21 by a hand-held cartridge 25. As a result of using the cartridge, the tool changing time is reduced and, perhaps more importantly, the press operator need not place his hands in the potentially dangerous area beneath the ram 11 of the press 10.

The present invention contemplates the provision of a new and improved cartridge 25 which, when compared to prior cartridges, effects more positive locking of the tools 12, 15 and 20, is easier to load and unload, and better insures against the possibility of the tools cocking or being installed with the wrong angular orientation. In addition, the cartridge of the present invention is easier to lift and maneuver than prior cartridges.

More specifically, the cartridge 25 includes a base 26 which supports a generally upright member or post 27.

A pair of pistol-type hand grips 28 are bolted to opposite sides of the post at 29. The hand grips 28 extend downwardly and rearwardly from the post 27 and may be used to lift the cartridge 25.

Figure 2:
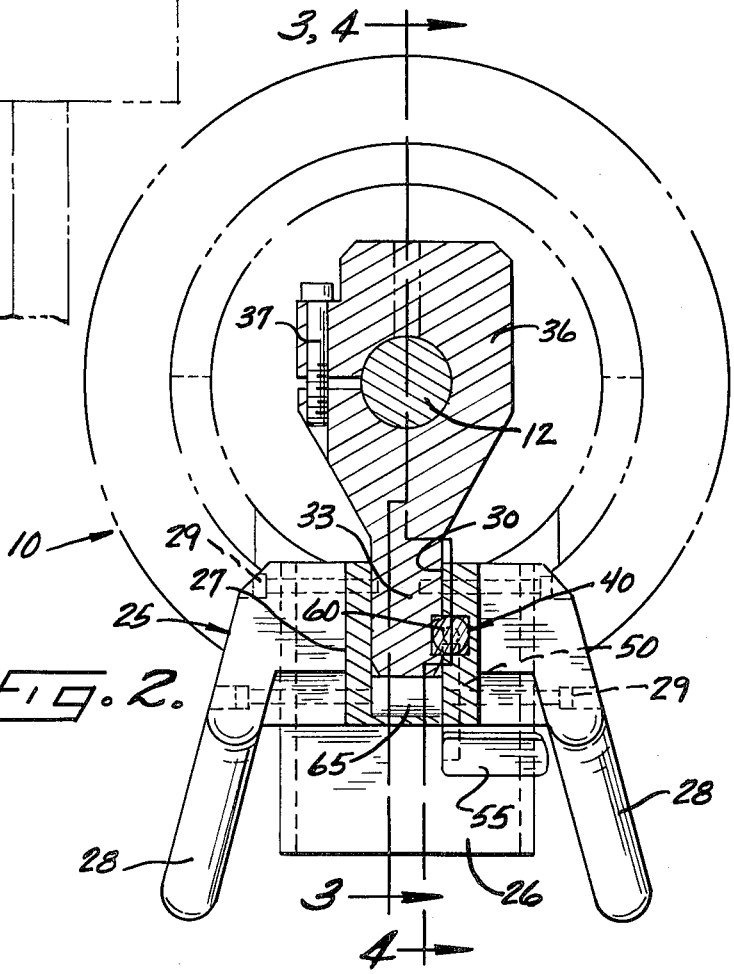
FIG. 2 is a cross-section taken substantially along the line 2—2 of FIG. 1.

In carrying out the invention, three vertically spaced sockets 30, 31 and 32 (FIG. 4) of rectangular cross-section are formed in the post 27 and open out of the forward side of the post. The three sockets are adapted to telescopically receive three correspondingly shaped tongues 33, 34 and 35 projecting laterally from the punch 12, the stripper 20 and the die 15, respectively. As shown in FIGS. 2 and 3, the tongue 33 is formed integrally with and projects laterally from a collar 36 which encircles the punch 12 and which is secured rigidly to the punch by a screw 37. The tongue 34 is bolted rigidly to the stripper 20 at 38 (FIG. 3) while the tongue 35 is bolted rigidly to the die adaptor 16 at 39.

With the foregoing arrangement, the tools 12, 15 and 20 may be loaded into the cartridge 25 simply by inserting the tongues 33, 34 and 35 into the sockets 30, 31 and 32, respectively. To hold the tongues releasably in the sockets, a locking pin 40 is supported to move upwardly and downwardly in a hole in the post 27 between a locked position (FIG. 3) and a released position (FIG. 4). The locking pin is formed with two reduced-diameter portions 41 (FIG. 4) which are located below two larger diameter portions 42.

The locking pin 40 normally is disposed in its locked position (FIG. 3) and is urged downwardly to that position by a coil spring 45. The spring is telescoped over an intermediate portion of the pin and its lower end bears against a washer 46 which is rigid with the pin. As shown in FIG. 4, the spring is disposed within an opening 47 in the post 27 and its upper end bears against the upper side of the opening.

To shift the pin 40 from its locked position to its released position, a lever 50 (FIG. 4) extends through an opening in the post 27 and is mounted to pivot about a horizontal pin 51 on the post. The forward end portion of the lever 50 underlies a large diameter portion 53 on the pin 40 while the rear end of the lever is formed with a thumbpiece 55. When the thumbpiece 55 is depressed downwardly, the lever 50 shifts the pin 40 upwardly to its released position. When the thumbpiece is released, the spring 45 returns the pin downwardly to its locked position.

When the pin 40 is in its locked position, the large diameter portions 42 thereof fit within recesses or notches 60 (FIGS. 4 and 5) formed in the tongues 33 and 34 of the punch 12 and the stripper 20, each notch being formed in one side of the tongue. In addition, the lower end portion of the pin extends into a recess or notch 61 formed in the side of the tongue 35 of the die 15. Accordingly, the pin locks the tongues securely in the sockets 30, 31 and 32.

When the pin 40 is shifted upwardly to its released position, the reduced-diameter portions 41 of the pin move into registry with the notches 60 to free the tongues 33 and 34 from the pin and to permit the tongues to slide endwise in the sockets 30 and 31. Also, the lower end of the pin retracts upwardly from the notch 61 in the tongue 35 to permit that tongue to be inserted into or removed from the socket 32.

The cartridge 25 is loaded by manually inserting the tongues 33, 34 and 35 endwise into the sockets 30, 31 and 32 while the locking pin 40 is held in its released position by depression of the thumbpiece 55. When the latter is released, the spring 45 shifts the pin to its locked position so as to lock the tongues securely within the sockets. Thereafter, the cartridge may be lifted by the hand grips 28 and moved sidewise to insert the tools 12, 15 and 20 into the holders 13, 17 and 21. After the tools have been locked in the holders by actuating the wedge 14, the clamp 18 and the stripper latching mechanism, the thumbpiece 55 may again be depressed to release the locking pin 40. The cartridge then is moved away from the tools and, as an incident thereto, the sockets automatically release the tongues.

Removal of the tools 12, 15 and 20 from the holders 13, 17 and 21 is effected in a reverse manner. That is, the thumbpiece 55 is depressed and the cartridge 25 is moved toward the tools to cause the tongues 33, 34 and 35 to telescope into the sockets 30, 31 and 32. After the thumbpiece has been released to lock the tongues, the tools are unlocked from the holders 13, 17 and 21. The cartridge with the tools coupled thereto then is shifted sidewise away from the ram 11.

Figure 5:
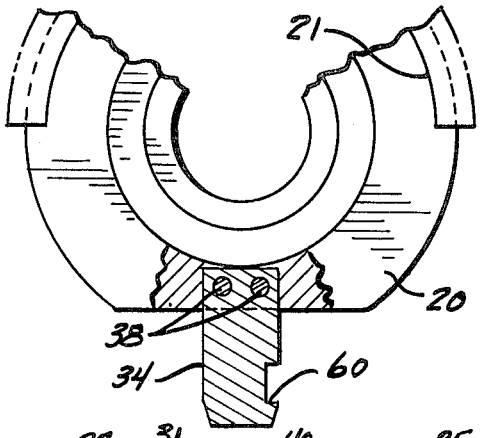
FIG. 5 is a cross-section taken substantially along the line 5—5 of FIG. 4.
Figure 5:
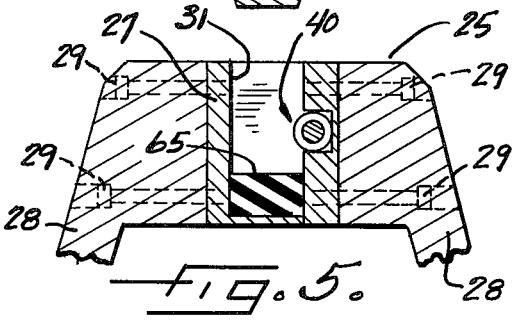

As shown in FIGS. 4 and 5, rubber bumpers 65 are seated against the closed end of the sockets 30, 31 and 32. When the tools 12, 15 and 20 are inserted into the holders 13, 17 and 21, the tongues 33, 34 and 35 press against the bumpers. By virtue of their resiliency, the bumpers allow the tongues to shift rearwardly to the extent necessary to insure that the tools seat properly in the holders. Thus, the bumpers permit simultaneous seating of the three tools in the holders even though the three tongues may not be exactly the same length or even though the three sockets may not be exactly the same depth.

The present cartridge 25 is easy to load and unload. It holds the tools 12, 17 and 20 with a positive action and prevents the tools from shifting or cocking prior to the time they are inserted into the holders 13, 17 and 21. There is no danger of the tools being angularly misoriented when loaded into the cartridge or the holders. And, the cartridge may be lifted and carried with relative ease since the telescopic effect of the tongues 33, 34 and 35 and sockets 30, 31 and 32 permits the tools themselves to be located closely adjacent the post 27 and the hand grips 28. Thus, the cantilever effect of the weight of the tools is comparatively small.

I claim:

1. The combination of a coacting punch and die and apparatus for inserting the punch and die into and for removing the punch and die from a punch press adapted to reciprocate the punch downwardly and upwardly, the punch and the die each having a laterally projecting tongue, said apparatus comprising a member having upper and lower sockets for telescopically and non-rotatably receiving the tongues on the punch and the die, respectively, and selectively releasable coacting means on each tongue and within each socket for retaining the tongue in the socket while permitting selective endwise removal of the tongue from the socket.

2. The combination defined in claim 1 in which said tongues and said sockets are of non-circular cross-section so as to prevent said tongues from rotating within said sockets.

3. The combination defined in claim 1 in which said member is a post, and at least one handle attached to said post to enable said apparatus to be manually lifted and moved.

4. The combination defined in claim 1 in which said means comprise recesses formed in said tongues, said means further comprising a pin supported by said member for upward and downward movement between locked and released positions, said pin being engageable with the walls of said recesses and holding said tongues in said sockets when said pin is in said locked position, and said pin being located out of engagement with the walls of said recesses and permitting endwise removal of said tongues from said sockets when said pin is in said released position.

5. The combination defined in claim 4 further including resiliently yieldable means acting on said pin and urging said pin to said locked position, and means engageable with said pin and manually movable to shift said pin to said released position.

6. The combination defined in claim 5 in which said last-mentioned means comprise a manually movable lever pivotally mounted on said upright member and having one end portion engageable with said pin.

7. The combination defined in claim 4 in which said pin includes at least one enlarged-diameter portion and at least one reduced-diameter portion, the enlarged-diameter portion of said pin being disposed in and being alined with the recess of one of said tongues when said pin is in said locked position, and the reduced-diameter portion of said pin being alined with such recess when said pin is shifted to said released position.

8. The combination defined in claim 1 further including resiliently yieldable means located in said sockets adjacent the closed ends thereof and engageable with the free ends of said tongues.

9. The combination of a coacting punch, stripper and die and a hand-held cartridge for inserting the punch, stripper and die into and for removing the punch, stripper and die from a punch press adapted to reciprocate the punch downwardly and upwardly, the punch, stripper and die each having a laterally projecting tongue, said apparatus comprising an upright member having upper, intermediate and lower sockets for telescopically and non-rotatably receiving the tongues on the punch, stripper and die, respectively, and a movable locking pin on said member and normally engageable with said tongues to hold said tongues in said sockets, said locking pin being manually movable to a released position permitting endwise removal of said tongues from said sockets.

* * * * *